United States Patent [19]

Angelo

[11] Patent Number: 4,838,250

[45] Date of Patent: Jun. 13, 1989

[54] BACK RELEASE APPARATUS

[75] Inventor: Ross P. Angelo, 5211 Victor St., Dallas, Tex. 75214

[73] Assignee: Ross P. Angelo, Dallas, Tex.

[21] Appl. No.: 187,912

[22] Filed: Apr. 29, 1988

[51] Int. Cl.[4] ..... A61H 1/02

[52] U.S. Cl. ..... 128/75; 272/144

[58] Field of Search ..... 128/70–75; 272/144, 143

[56] References Cited

U.S. PATENT DOCUMENTS

| | | | |
|---|---|---|---|
| 1,426,422 | 8/1922 | Stowe | 128/72 |
| 2,487,730 | 11/1949 | Robb | 272/144 |
| 3,286,708 | 11/1966 | Gartner | 128/70 |
| 3,293,667 | 12/1966 | Ohrberg | 128/68 |
| 3,519,268 | 7/1970 | McQueen | 272/144 |
| 3,568,669 | 3/1971 | Stites | 128/71 |
| 3,896,798 | 7/1975 | Simon | 128/75 |
| 4,232,662 | 11/1980 | Barber | 128/71 |
| 4,372,552 | 2/1983 | Carlmark | 128/75 |
| 4,494,532 | 1/1985 | Masuda | 128/71 |
| 4,502,682 | 3/1985 | Miller | 272/144 |
| 4,534,555 | 8/1985 | McGowen | 128/71 |
| 4,635,934 | 1/1987 | Roethke | 272/144 |
| 4,746,116 | 5/1988 | Imada | 282/144 |

FOREIGN PATENT DOCUMENTS 3420858 12/1985 Fed. Rep. of Germany ..... 128/71

*Primary Examiner*—David A. Wiecking
*Assistant Examiner*—Huong Q. Pham

[57] ABSTRACT

An apparatus for applying deep, steady pressure into the deep tissue layers of the muscles of a human user and to "adjust" the vertebrae of the spine, to relieve back pain in a human user. The apparatus is comprised principally of a frame (36), that is collaspable and adjustable, and a back-engaging member (26), whereby a human user can support himself by resting his arms and hands on the arm-rest members (25), by resting his feet on the foot-rest members (32), and be leaning his back against the back-engaging member, and when the user pushes his body weight against said back-engaging member, and if he chooses, takes his feet off the said foot-rest members (32) to allow his feet to be suspended off the ground, the force of gravity as well as slight movement on the part of the user, causes the back-engaging member to apply a deep, steady, slowly sliding pressure into the muscles of the dorsal side of a user's body, relaxing and releasing muscle tension and effecting a spinal adjustment.

4 Claims, 3 Drawing Sheets

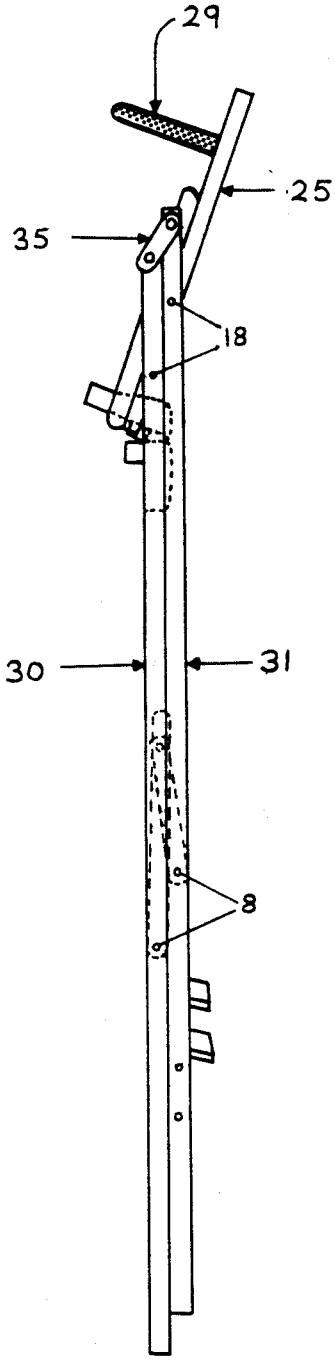
FIG 3
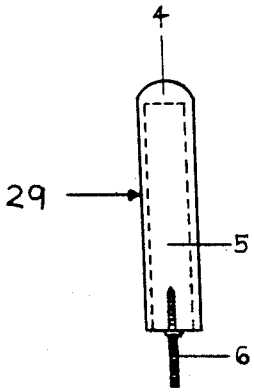
FIG 4
FIG 5
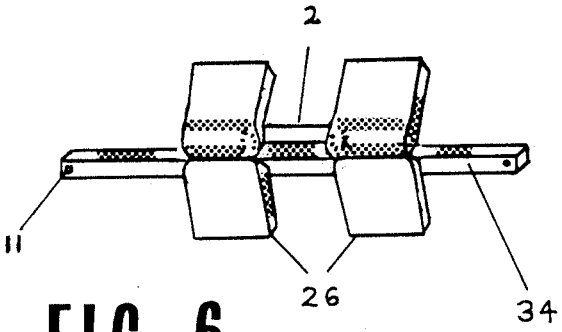
FIG 6
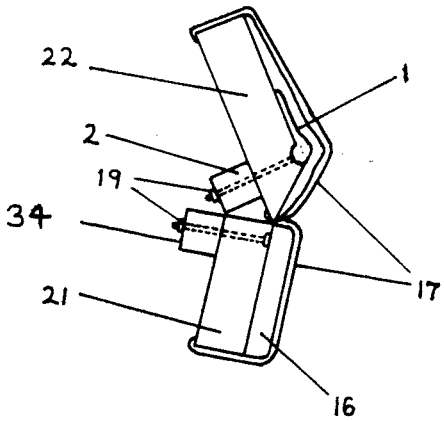

BACK RELEASE APPARATUS

BACKGROUND AND BRIEF INTRODUCTION TO THE INVENTION

In the course of my practice, as a liscensed massage therapist specializing in deep-tissue massage, I have discovered and invented a gravity traction apparatus, whereby both the superficial and deep connective tissues on the dorsal side of a human body can be substantially subjected to deep, steady pressure, relieving stress and tension in the muscles and fascia of the dorsal side of the body, and in most cases release luxations and subluxations of the vertebral column.

It is well known to the massage professional trained in deep-tissue massage that deep, steady pressure applied to the human body can release both superficial and deep fascia. The word "fascia" means "band" and is applied to fibrous or membranous expansions of connective tissue which are wrapped around various structures of the human body, especially muscles, wherein they are termed epimysial sheaths.

The back release apparatus is designed and constructed to substantially manipulate said fascia on generally the dorsal side of a human body. When a human user engages his dorsal body on the back-engaging member and slowly slides down said member in a twisting, hanging fashion; deep, steady pressure is applied to the muscles and fascia of the back similar to the manual "myofascial-release" techniques applied by massage professionals trained in deep-tissue massage, whereby a release of tension and stress is effected in the muscles as well as a natural adjustment of the vertebral column.

According to my investigations, there is no prior art that duplicates the type of deep, slowly sliding, steady pressure to the dorsal side muscles of the human body along with the spinal adjustment, as said back release apparatus.

The apparatuses provided by the prior art and referred to below have numerous disadvantages and were not designed to effect both a deep release of muscle tissue and fascia, and release spinal subluxations/luxations as well.

Other prior art apparatuses provide generally traction with a person in the upright or inverted position, they provide a spinal adjustment, they massage superficially generally the muscles of the back or they exercise the hip and torso region of a human body, but none provide said deep, slowly sliding, steady pressure to the deep muscle tissues of the back as said back release apparatus along with a spinal adjustment.

Typical of aforementioned appartuses are the spinal adjustment devices, as disclosed in U.S. Pat. No. 3,709,216, and the inverted traction apparatuses disclosed in U.S. Pat. Nos. 4,566,693; 4,534,554; 4,534,555; 4,461,287; 4,502,682, and the upright traction apparatuses disclosed in U.S. Pat. Nos. 3,685,511; 3,896,798; 4,372,552; 2,447,698; 3,835,844; 3,353,532; 3,889,664; and 786,672.

The patents to Robb (U.S. Pat. No. 2,487,730), Alvarez (U.S. Pat. No. 3,685,511), Carlmark (U.S. Pat. No. 4,372,552), Inada (U.S. Pat. No. 4,746,116), and Pfund (U.S. Pat. No. 786,672) shows pads or members for engaging the back, but none provide the novel double pad with bumps that press specifically and deeply into the muscles along the sides of the spinal column of a user as the back-release apparatus does. And none of these patents provide support for the arms and hands for the purpose of allowing the user to hang his feet while engaging pressure on the back-engaging double pads and for the purpose of sliding down the pads all the way to the user's neck. While Inada's invention does provide hand grips with a back support, it is not designed to allow the user to hang his feet nor does the back support engage deep pressure into the back. While foot-rests are provided for some of these patents, they are not built or positioned so that a user can lean his back deeply into the back-engaging pads by pressing his feet on the foot rest.

The patents to Masuda (U.S. Pat. No. 4,494,532), Hillyard (U.S. Pat. No. 3,709,216), Miller (U.S. Pat. No. 4,502,682), McGowen (U.S. Pat. No. 4,534,555), Barber (U.S. Pat. No. 4,232,662), and Stites (U.S. Pat. No. 3,568,669) are inventions designed to put the user generally in an inverted hanging position, while the back-release apparatus is designed generally to allow a user to hang in his normal upright position (head up, feet down), never in an inverted position (head down, feet up). The mentioned inventions above contain foot-rests and generally A-shaped frames, similar to the back-release apparatus, but they do not contain arm-rests with hand grips and back-engaging pads to allow a user to hang or slide his back down the back-engaging pads to adjust his spinal column and deeply massage his back.

The patents to Matuscheke (German patent DE 3420-858) and Simon (U.S. Pat. No. 3,896,798) contain arm rests and foot rests that allow a user to hang in an upright position and perform abominal/hip exercises, but they do not contain back-engaging pads so that the user can give himself a deep pressure massage to the muscles of his back as he is hanging or sliding down the back-engaging pads. These mentioned inventions above are designed for exercise purposes, not massage purposes as is the major purpose of the back-release apparatus.

Carlmark (U.S. Pat. No. 4,372,552) provides an apparatus with overhead handgrips and a back support so that a person can hang in an upright position, but the back support is not designed to press deeply into the back, nor can the user lean his back with pressure into the back-support, because no horizontal arm-rests with handgrips are provided in a position where the user can support his arms and hands at the level of his torso (not overhead), which is provided by the back-release apparatus and is essential for giving the user leverage to push his body backwards and engage deep pressure into the back-engaging pads.

OBJECTS AND ADVANTAGES

With the foregoing limitations and deficiencies of known apparatuses in view, the object of the invention is new, unexpected, unsuggested, and superior in the function of providing a deep muscle tissue massage and spinal adjustment to the dorsal side of a user's body through the use of specially designed contoured pads that a user can lean against, or slide against, while supporting himself with an arm rest and hanging his feet off the ground to provide deeper penetration of the pads into the muscles of his back. The invention also allows the user to move the position of his body so that he can massage other areas of his body (with his feet on or off the ground).

The prior art references mentioned above do not contain any suggestion that they be combined, or that they be combined in the manner in which the back-release apparatus is designed. If the apparant combination employed by the back-release apparatus (consisting of a two paded back-engaging member with bumps that press into both sides of the spine, arm-rests, hand grips, and foot-rests, all secured to a collapsible frame) were in fact obvious, those skilled in the art surely would have implimented it by now. I.e., the fact that those skilled in the art have not implimented the invention, despite its advantages, indicates it is not obvious. It is the inventor's knowledge of deep-tissue massage that allowed him to develop this novel invention, which allows the user to give himself a deep-tissue massage and adjust his spine.

Another object is to provide an apparatus which will enable the user, if he or she chooses, to exercise his or her lower torso and upper legs, especially the abdominal, hip, and lower back muscles.

A further object is that said apparatus can be made to occupy substantially little floor space and, if desired, can be collasped, made portable, and stored in a closet or other limited space when not in use.

Another object is that the apparatus be constructed of strong enough tensil strength to easily hold the weight of a human being, that it be rugged and durable, yet relatively light weight so that one individual can carry it without undue strain.

It is a further object to provide such an apparatus which is relatively safe to use by even the most inexperienced and non-athletic person.

Another object is to provide such an apparatus that can be operated alone, by one human user at a time, without requiring the assistance of another human being.

An important object is to provide an apparatus which will enable a user to arch his upper torso backward while maintaining balance with his arms and hands on the horizontal arm-rest, while maintaining constant, steady, slowly sliding pressure on the muscles of the dorsal side of the body, thereby causing a release of deep and superficial muscular tension, increasing the flow of blood and lymph in the tissues of the back, improving flexibility and ease of movement generally of the muscles and bones of the back, and adjusting the vertebral column to its proper position.

An additional object is to provide such an apparatus which can be quickly and easily adjusted to accommodate persons of different heights and sizes.

These and other objects of the invention will become apparent from the description of a preferred embodiment of the invention, in connection with the accompanying drawings and description, whereby it will become understood that the invention consists of certain novel details of construction and combinations of parts herein after more fully described and pointed out in the claims, it being understood that changes may be made in the construction and arrangement of parts without departing from the spirit of the invention as claimed.

BRIEF DESCRIPTION OF THE DRAWINGS

FIG. 3 is a side elevational view of the apparatus in the collasped, storage ready position.

FIG. 4 is a front, enlarged view of a handle (29) afixed to the top, anterior portion of the arm-rest members.

FIG. 5 is a front, isolated, enlarged view of the back-engaging member (26) secured on the horizontal beam member (34) and the upper brace rod (2).

FIG. 6 is a side, elevational, enlarged, isolated view of the back-engaging member and horizontal beam-member.

DETAILED DESCRIPTION OF THE DRAWINGS

Figure 1:
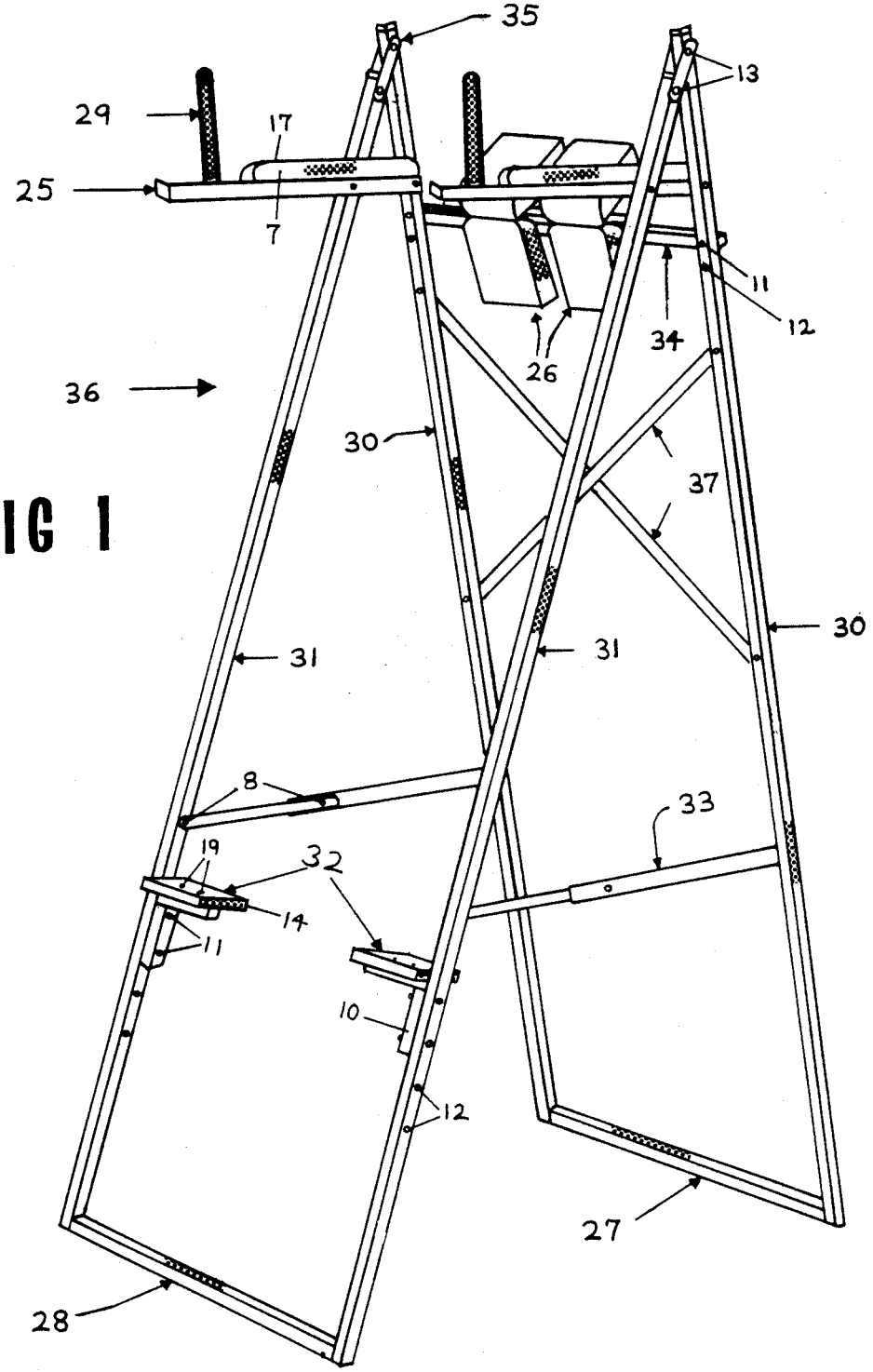
FIG. 1 is a perspective front elevational view of the preferred form of a back release apparatus, shown in the operative position.

FIG. 1 is a perspective front elevational view of the preferred form of a back release apparatus, constructed in accordance with the instructions of said apparatus, shown in the operative position.

The illustrated embodiment of FIG. 1 comprises a supporting A-shaped frame structure (36), a horizontal beam member (34) with a back-engaging member (26) afixed adjacent the center lengthwise portion of said horizontal beam member.

The frame (36) is foldable and collapsible and is comprised of two front, angled, elongated support members, called front legs (31), which are attached at their lowest point by a horizontally disposed front cross bar (28) and two back legs (30) attached by a horizontally disposed back cross bar (27), and said front and back cross bars are positioned so that they rest horizontally flat and parallel on a level floor surface.

Said front and back legs are adjustably and pivotally secured by four, two holed securing members (35), by two horizontally disposed, forwardly extending arm-rest beams (25) and two suspension ties (37) are secured to the posterior portion of said back legs (30).

Said suspension ties (37) prevent the legs (30,31) of said frame (36) from spreading or sliding in a lateral direction, and folding side brace members (33) prevent said legs from spreading outwardly in a forward and backward manner and out of proper relationship, to maintain the desired A-shaped frame structure while bearing the weight of a human user.

The foot-rest members (32) are horizontally and transversely disposed on the lower, front legs (31) of said frame (36), and are adjustably secured to the medial sides of said front legs (31).

Said foot-rest members (32) are comprised of generally a plurality of angled rods (10) attached to the medial sides of said front legs (31) by generally two bolts with wing nuts (11) on each front leg (31) and generally two bolts with nuts (19) attached to the parallel, flat supports (14) used generally for support of a user's feet, and generally extra holes (12) are provided to allow said foot-rest members (32) to be adjusted vertically to a higher or lower position.

A handle member (29), rubber pads (7), and cloth cover means (17) are afixed ontop the majority of the arm-rest beams (25), in order to comfortably support the arms and hands of a human user.

Tubular rivots (13) are used to attach securing members (35) and the upper most portions of said front and back legs together, and pop rivots (8) are used to secure both suspension ties (37) to said back legs (30) of the frame (36).

Figure 2:
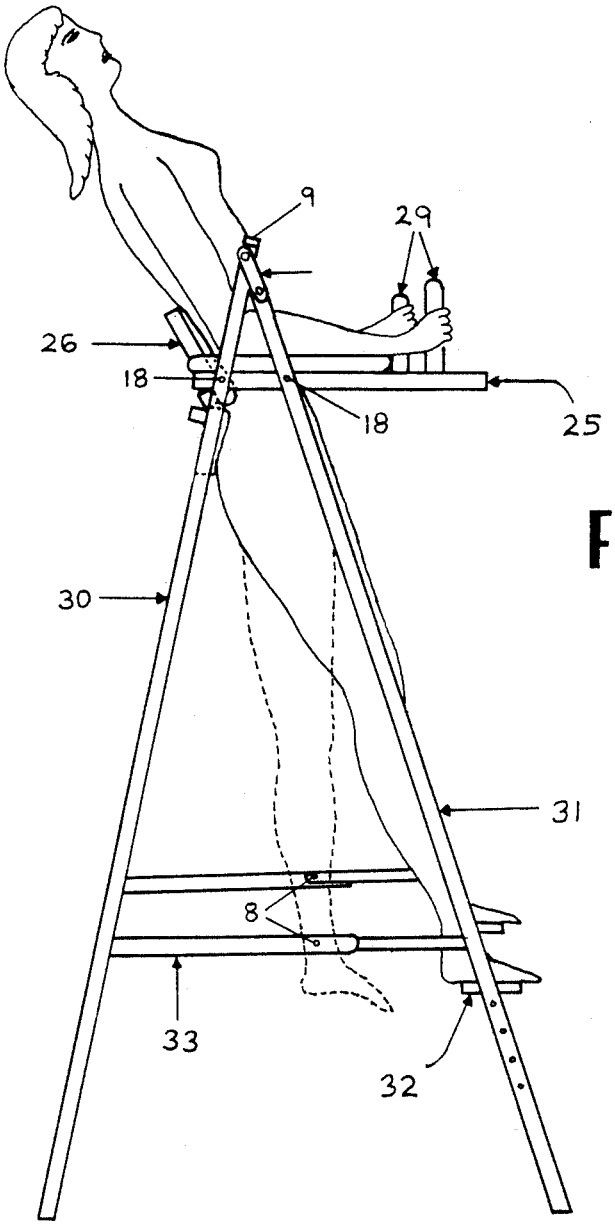
FIG. 2 is a side elevational view of the apparatus in the operative position, shown with a human user utilizing the arm-rest beams (25), foot-rest members (32), and back-engaging member (26) for support.

FIG. 2 is a side elevational view of the apparatus in the operative position, shown with a human user utilizing the arm-rest beams (25), foot-rest members (32), and back engaging member (26) for support.

The user may, if he desires, slide his back muscles down said back-engaging member (26), while supporting one or both feet on the foot-rest members (32) or he may take his feet off the foot-rests (32) and substantially swing his legs and lower torso in various directions to obtain a deeper penetration of the back-engaging member (26) into the muscles of his back. In addition, if the user desires, he may exercise generally the muscles of his lower torso, buttocks, and upper legs by engaging his back against said back-engaging member (26) and moving his lower body in various positions.

In addition, the user may, if he desires, move the position of his arms in a "winged-out" position so that his body slides substantially downward and his forearms are in a horizontal, transversing position in relation to his body, in order to massage and release the upper muscles and vertebrae of the back.

In addition, the user may, if he desires, massage his upper shoulder muscles by standing on the floor or foot-rest and push his shoulder muscles and even neck muscles upward and into the outwardly protruding structure of the lower aspect of the back-engaging member (26), and while engaging steady pressure of his upper back against the back-engaging member, he may slide in an opposite direction from his upper back down to his lower back, releasing muscle tension and vertebral subluxations.

The arm-rest beam members (25) are pivotally attached to the front and back legs (30,31) of said frame (36) by bolts with lock nuts (18) as shown in FIG. 2. and plastic caps (9) cover the top portions of said legs (30,31).

In addition, FIG. 2 illustrates a folding side brace (33) that is comprised of two elongated rods attached together by a pop rivot (8) and the other ends of said rods are attached to said back and front legs (30,31) by pop rivots (8), thereby preventing said legs (30,31) of said frame (36) from sliding laterally or outwardly while supporting the weight of a human user, and by the hinging action of said folding braces, said frame may be collasped into the inoperative, storage ready position, as shown in FIG. 3.

FIG. 3 is a side elevational view of said apparatus in the collasped, storage ready position. The said securing members (35) are pivoted into a more vertical position as the front frame legs (31) are moved slightly upwards and backwards against the said back legs (30) by the pivoting action of bolts with lock nuts (18), and the said arm-rest members (25) are moved into a more vertical, almost 45° angled position.

FIG. 4 is a front, enlarged view of a handle (29) afixed to the top, anterior portion of said arm-rest members, comprising a hanger bolt (6) afixed and screwed into the lower and generally of a wooden dowel (5), the opposite end of said hanger bolt (6) and a securing nut is used to attach said handle (29) to said arm-rest member (25), a grip cover (4) is fitted onto and over the said wooden dowel (5), giving the handle a cushioned fit that is comfortable for a user to hold.

FIG. 5 is a front, isolated, enlarged view of the back-engaging member (26) secured on the horizontal beam member (34) and the upper brace rod (2), in which, as FIG. 1 illustrates, said horizontal beam member is secured to said back legs (30) by nuts and bolts (11), and extra holes (12) are provided on said back legs so that said horizontal beam member (34) can be adjusted in a vertical direction, allowing the back-engaging member to be positioned at the proper position for a human user.

FIG. 6 is a side, elevational, enlarged, isolated view of the back-engaging member and horizontal beam-member, comprising generally two lower back support bases (21) and two upper back support bases (22), and said lower back support bases (21) are secured to the horizontal beam member (34) by means generally of nuts and bolts (19), and the upper bases (22) are secured to a horizontally angled, upper brace rod (2) by means generally of nuts and bolts(19).

Anatomically contoured, molded, back support means (1) are secured upon the upper portion of said upper bases (22), so that the back-engaging member will engage the proper muscles of the back of a human user and be comfortable to a human user.

In addition, rubber padding (15) is secured ontop of the back support means (1) and foam cushions (16) are secured ontop of the lower bases (21), and a cloth cover (17) surrounds the outermost portion of the back-engaging member like skin, providing the back-engaging member with a cushioned, safe, comfortable, and anatomically shaped structure.

While the above description contains many specificities, the reader should not construe these as limitations on the scope of the invention, but merely as exemplifications of preferred embodiments thereof. Those skilled in the art will envision many other possible variations that are within its scope. For example, skilled artisans will readily be able to make a back release apparatus of alternative materials. They can make many variations of the frame (36), which can be either collaspable or not collaspable. They can make variations of the shape and size of the back-engaging member, so long as it accomplishes the desired pressure into the muscles of the back. These and many other variations can be envisioned, but the reader is requested to determine the scope of the invention by the appended claims and their legal equivalents, and not by the examples which have been given.

I claim:

1. A massage and exercise apparatus for adjusting the spinal column of a user while applying a deep massage to the user's body comprising a generally A-shaped collaspable frame with inclined front and back sides including front and back legs pivotally connected at their upper ends by holed securing members, side brace member extending from each front leg to its corresponding back leg, two longitudinally extending arm-rest bars, each arm rest bar being pivotally supported by one of said front legs and one of said back legs, each said arm rest bar having arm pads and hand grips, a foot rest secured to each of said front legs, a horizontal beam extending between said back legs at a level slightly below level of said arm-rest bars, two massage applying pads with protruding ends attached to said horizontal beam and spaced from each other to press into the muscles that lie along side a user's spinal column when a user supports his arms on the arm rest pads and his feet on the foot rests whereby he can lean back against said massage applying pads, and stretch his spine and massage his back by hanging his feet.

2. The apparatus of claim 1, wherein the two massage apply pads are contoured substantially to press into the muscles that lie along side a user's back, neck, shoulders, buttocks, and scalp.

3. The apparatus of claim 1, in which the massage applying pads and foot rest members are vertically adjustable in a plurality of positions to bring the massage applying pads into proper position relative to the lower back of the user, supported predominated by his arms and hands on the arm-rest pads.

4. The apparatus of claim 1, wherein the massage applying pads and arm-rests pads are positioned so that a user can press his back muscles into the massage applying pads while hanging his feet free from the foot rests.

* * * * *